US005347891A

United States Patent [19]

Kamp et al.

[11] Patent Number: 5,347,891

[45] Date of Patent: Sep. 20, 1994

[54] ADJUSTABLE SPANNER WRENCH ASSEMBLY

[75] Inventors: Michael E. Kamp, Goodfield; Michael W. Rabe, Glasford, both of Ill.

[73] Assignee: Caterpillar Inc., Peoria, Ill.

[21] Appl. No.: 111,324

[22] Filed: Aug. 24, 1993

[51] Int. Cl.[5] ..... B25B 13/16

[52] U.S. Cl. ..... 81/175; 81/120; 81/176.3

[58] Field of Search ..... 81/176.1, 176.2, 176.3, 81/175, 120

[56] References Cited

U.S. PATENT DOCUMENTS

| | | | |
|---|---|---|---|
| 2,263,564 | 11/1941 | Boynton | 81/176.15 |
| 2,719,025 | 9/1955 | Stone | 81/176.3 X |
| 2,991,676 | 7/1961 | Bond | 81/176.3 |
| 4,896,571 | 1/1990 | Perry | 81/120 |

*Primary Examiner*—James G. Smith
*Attorney, Agent, or Firm*—Claude F. White

[57] ABSTRACT

An adjustable wrench assembly for installing and removing a threaded cap member of an hydraulic cylinder assembly includes a head member adapted to partially surround the piston rod of the cylinder assembly. A cover plate attaches to the head member to completely surround the piston rod. A plurality of adjustable contact pins accommodate various sizes of piston rods and are engagable with the piston rod to keep the wrench square and prevent it from twisting. Various sizes of adapter plates are connectable to the head member and include a plurality of engagable pins to engage mating slots or holes in the cap member. The adjustable contact pins include non-metallic plastic contact portions to prevent marring of the piston rod.

16 Claims, 3 Drawing Sheets

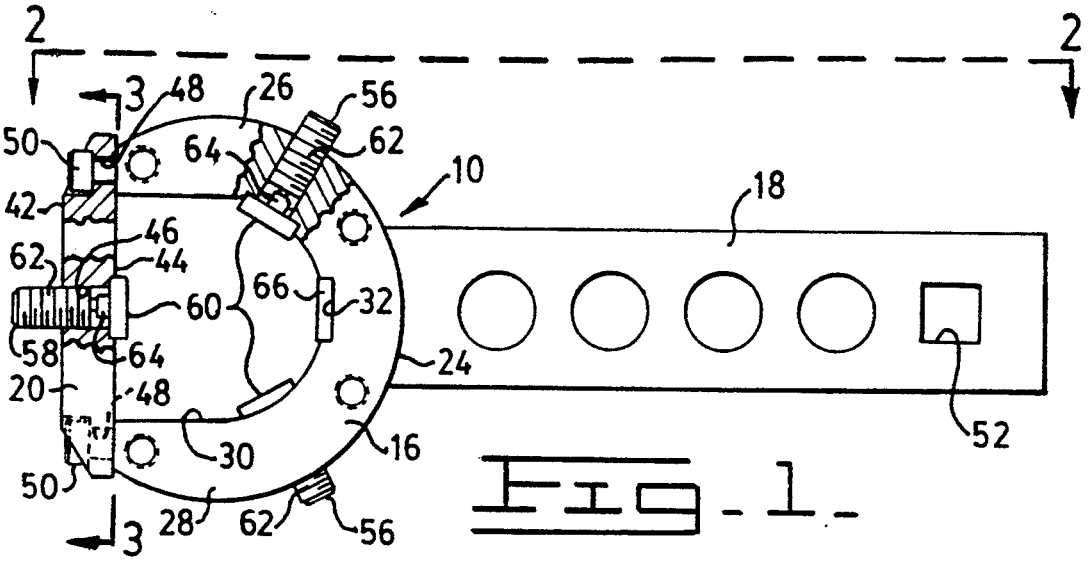
Fig. 1.
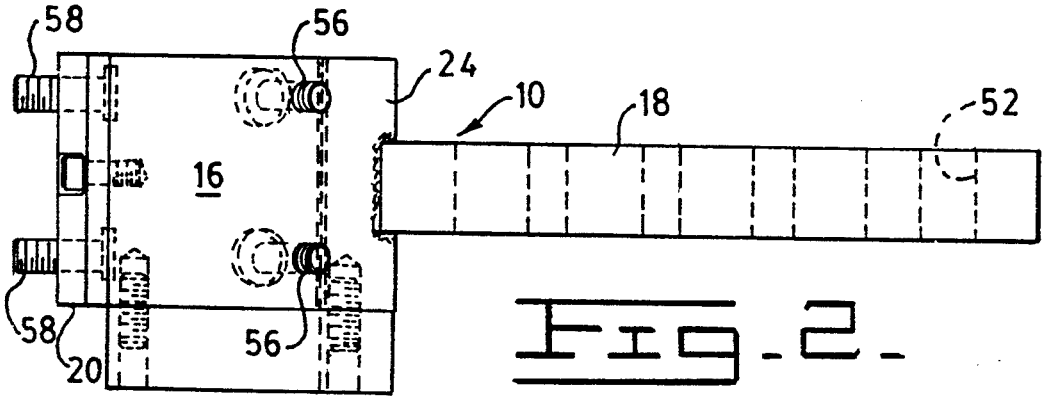
Fig. 2.
Fig. 3.
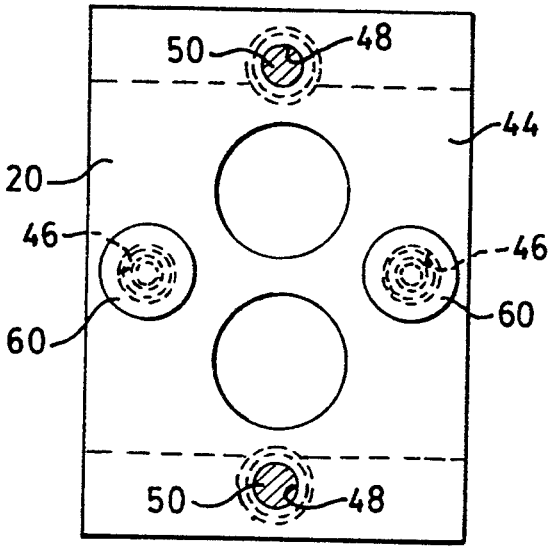

ADJUSTABLE SPANNER WRENCH ASSEMBLY

TECHNICAL FIELD

This invention relates generally to a spanner wrench assembly, and more particularly to an adjustable wrench assembly for assembling and disassembling various sizes of components.

BACKGROUND ART

Industry usage of hydraulic cylinder assemblies utilizing threaded insert cylinder caps is rapidly increasing. These insert caps have external threads which mate with internal threads in the cylinder barrel. When assembled to the cylinder barrel, the insert caps must be tightened to a specified torque. A spanner type wrench is usually used to assemble and disassemble the cap and the barrel, with the wrench having engaging pins to engage slots or holes in the cap. Removal of the cap is usually very difficult due to rusting, corrosion, and denting of the cap and/or cylinder barrel. These problems increase the torque required to remove the cap, and it is very difficult to maintain engagement of the wrench with the cap slots. Installation and removal is even more difficult because the caps are usually cast, resulting in the slots having radiused corners and wall surfaces having a draft angle. The use of very large pipe wrenches and chain type wrenches has been only marginally successful due to the width and overall diameter of the caps. Still another problem is that each hydraulic cylinder size requires a separate wrench to fit that particular cylinder cap.

The present invention is directed to overcoming one or more of the problems as set forth above.

DISCLOSURE OF THE INVENTION

In one aspect of the present invention, an adjustable spanner type wrench assembly for installing and removing components of a structure includes a head member, a cover plate, a handle member connected to the head member, and an adapter plate connectable to the head member. The head member and the adapter plate each have a generally U-shaped configuration and include first and second leg portions. The adapter plate includes a plurality of component engagable pins. The wrench assembly further includes a plurality of first adjustable contact pins associated with the head member, and a plurality of second adjustable contact pins associated with the cover plate.

Large size hydraulic cylinder assemblies, having threaded insert cap members, require torque forces of high magnitude to assemble and disassemble the threaded cap members. Conventional spanner type wrenches are difficult to use because it is hard to hold the wrenches square and prevent them from slipping out of engagement with the threaded cap members.

The subject adjustable wrench assembly provides a solution to the above problems by securely holding the wrench in place and preventing the wrench from "cocking" or twisting. The subject wrench has a plurality of adjustable pins to accommodate different cylinder rod sizes, and the adjustable pins have non-metallic contact pads to prevent marring of the cylinder rods.

BRIEF DESCRIPTION OF THE DRAWINGS

FIG. 1 is a diagrammatic side elevational view, partly in section, of the subject wrench assembly;

FIG. 2 is a diagrammatic plan view taken generally along lines 2—2 of FIG. 1;

FIG. 3 is a diagrammatic plan view of the subject cover plate, taken generally along lines 3—3 of FIG. 1;

BEST MODE FOR CARRYING OUT THE INVENTION

Figure 5:
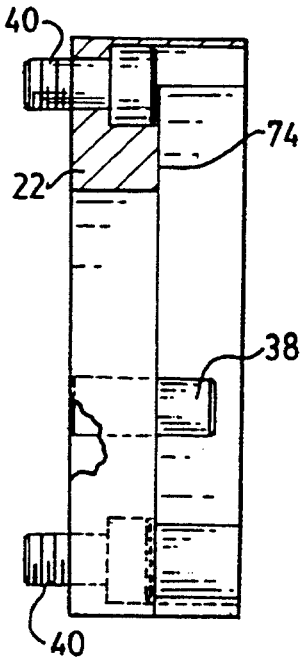
FIG. 5 is a diagrammatic sectional view, taken generally along the lines 5—5 of FIG. 4.

Referring to the drawings, an adjustable spanner type wrench assembly 10 for installing and removing a threaded insert cap member 12 of a hydraulic cylinder barrel 14 includes a head member 16, a handle member 18, a cover plate 20, and an adapter plate 22. The head member 16 has a circumferential surface 24 and a U-shaped configuration which defines first and second leg portions 26,28, and an interior cavity 30 between the leg portions 26,28. The head member 16 further defines a longitudinal slot 32 at the base of the cavity 30. In order to service different sizes of cylinder caps 12, the wrench assembly 10 will accommodate various adapter plates 22. Each adapter plate 22 has a generally U-shaped configuration, which defines first and second leg portions 34,36, and a plurality of component engagable pins 38. Each adapter plate 22 is releasably connectable to the head member 16 by a plurality of first threaded fasteners 40.

The cover plate 20 has first and second spaced apart surface portions 42,44 and a plurality of first and second apertures 46,48. The apertures 46,48 extend through the plate 20 from the first surface portion 42 to the second surface portion 44. A plurality of second threaded fasteners 50 are adapted to extend through the second apertures 48 and releasably connect the cover plate 20 to the first and second leg portions 26,28 of the head member 16, and thereby partially enclose the cavity 30. The handle member 18 is connected, as by welding, to the circumferential surface 24 of the head member 16. The handle member 18 defines a substantially rectangular shaped hole 52, which is adapted to accommodate a torque measuring device 54.

The wrench assembly 10 further includes a plurality of first adjustable contact pins 56 and a plurality of second adjustable contact pins 58. The first contact pins 56 are connectable to the head member 16, and the second contact pins 58 are connectable to the cover plate 20 and are adapted to be positioned in the first apertures 46. Each of the first contact pins 56 is adapted to extend into the cavity 30, and each of the second contact pins is also adapted to extend into the cavity 30 when the cover plate 20 is connected to the head member 16. Each of the first and second contact pins includes a non-metallic plastic contact portion 60, a threaded shaft portion 62, and a swivel portion 64 connecting the contact portion 60 to the shaft portion 62. A rectangularly shaped non-metallic plastic plate 66 is adapted to be positioned in the longitudinal slot 32.

Figure 4:
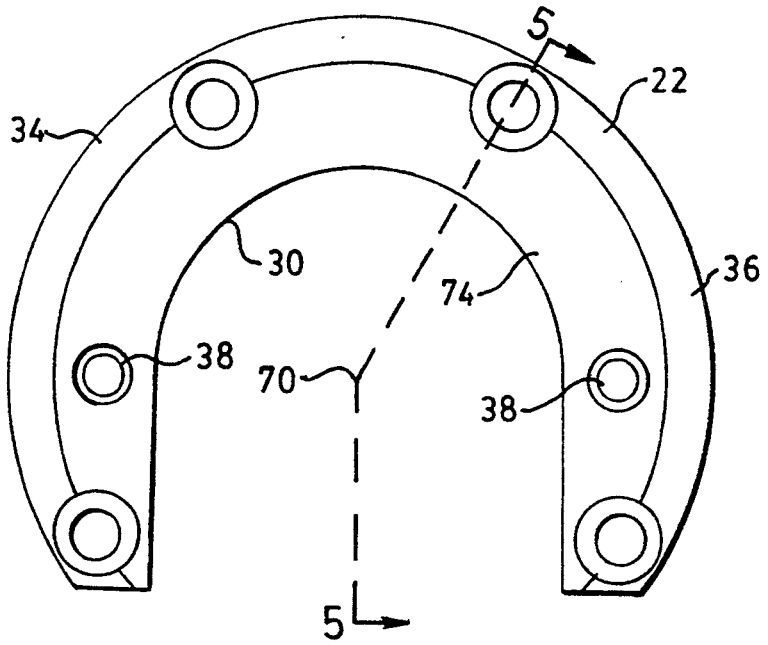
FIG. 4 is a diagrammatic enlarged plan view of one type of adapter plate.

With particular reference to FIGS. 4 and 5, one type of adapter plate 22 is shown which has an axial centerline 70. The component engagable pins 38 of this adapter plate 22 extend outwardly of the first and second leg portions 34,36 and substantially parallel to the axial centerline 70. The threaded cap member 12 has a plurality of slots or holes 72 and the pins 38 are adapted to engage the slots or holes 72 during an installation or removal of the cap member 12. Although two pins 38 are shown, it is understood that any number could be used to correspond with the number of slots or holes 72 in the threaded cap member 12. The leg portions 34,36 define a step portion 74 and the component engagable pins 38 preferably extend outwardly of the step portion 74.

Figure 7:
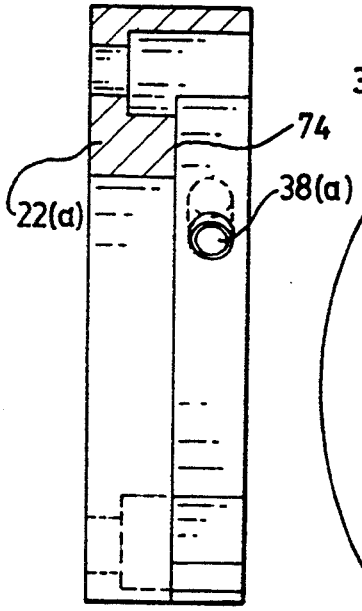
FIG. 7 is a diagrammatic sectional view, taken generally along the lines 7—7 of FIG. 6.
Figure 6:
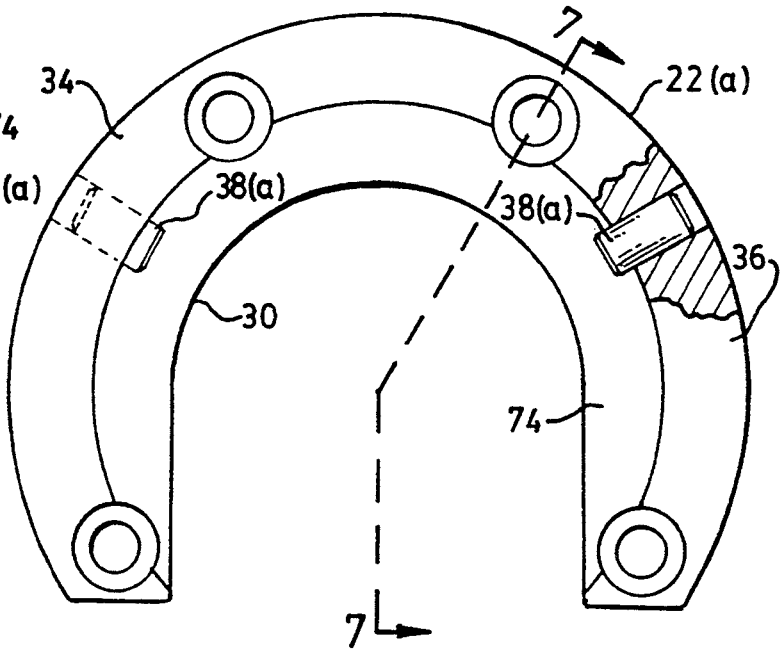
FIG. 6 is a diagrammatic enlarged plan view of a second type of adapter plate.

With particular reference to FIGS. 6 and 7, an alternate adapter plate 22(*a*) is shown wherein the leg portions 34,36 also define a step portion 74. The component engagable pins 38(*a*) of this alternate adapter plate 22(*a*) extend outwardly of the leg portions 34,36 and radially inwardly toward the cavity 30, and are positioned above the step portion 74. Although two pins 38(*a*) are shown, it is understood that more than two could be used to correspond with the number of slots 72 in the threaded cap member 12.

Figure 8:
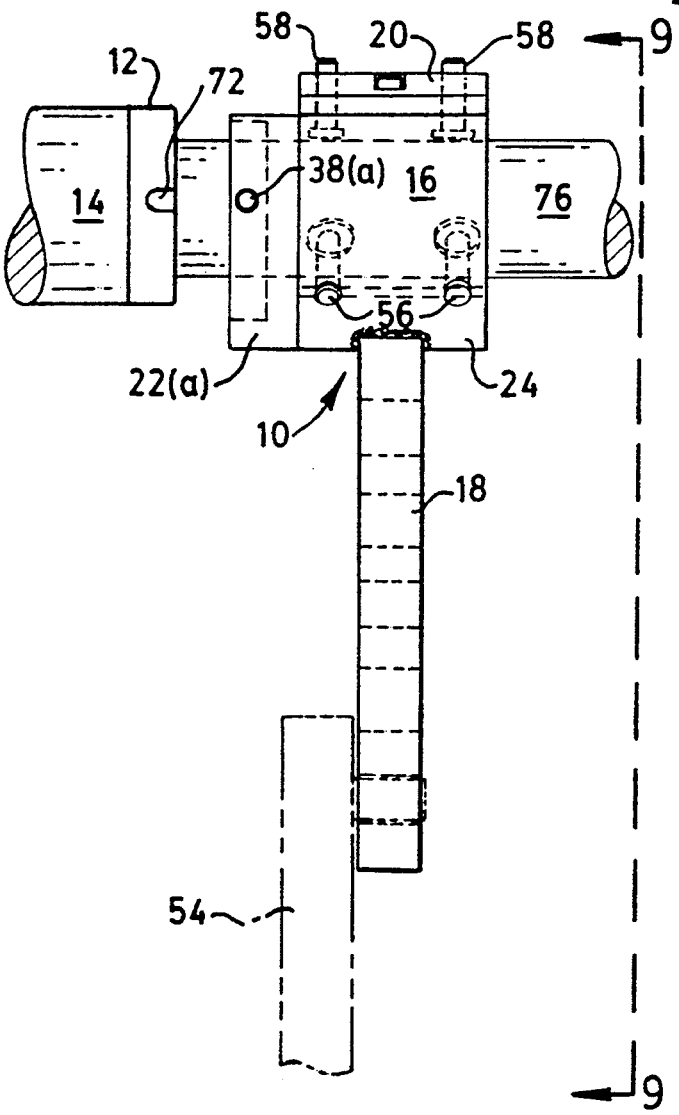
FIG. 8 is a diagrammatic plan view of the subject wrench assembly mounted on a hydraulic cylinder assembly.
Figure 9:
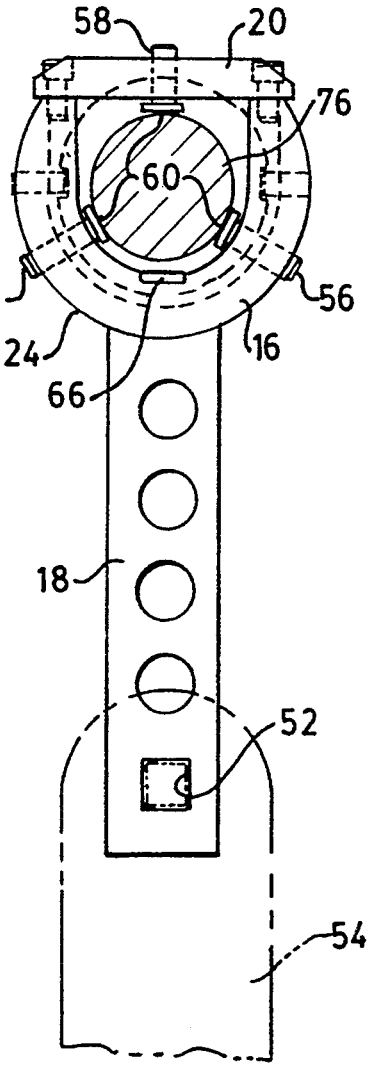
FIG. 9 is a diagrammatic sectional view, taken generally along the lines 9—9 of FIG. 8.

With particular reference to FIGS. 8 and 9, the adjustable spanner wrench assembly 10 is shown on a piston rod 76 prior to engagement with the threaded cap member 12. The first and second adjustable contact pins 56,58 have been adjusted to bring the contact portions 60 into engagement with the piston rod 76 and to center the wrench assembly 10 on the rod 76. The adapter plate 22(*a*) is shown slightly spaced from the cap member 12. To remove the cap member 12, the wrench assembly 10 is moved along the rod 76 until the pins 38(*a*) engage the slots 72. Force is then applied to the handle member 18 to remove the cap member 12 from the cylinder barrel 14. The wrench assembly 10 can be moved along the rod 76 and rotated without marring the rod 76 because the non-metallic contact portions 60 are in contact with the rod 76. Prior to applying a force to the handle member 18, the contact pins are adjusted to keep the wrench assembly 10 square with the rod 76 and to keep the wrench assembly 10 from "cocking" or twisting.

INDUSTRIAL APPLICABILITY

With reference to the drawings, the subject adjustable wrench assembly 10 is particularly useful for installing and removing a threaded cap member 12 onto and from a hydraulic cylinder barrel 14. For a removal operation, the head member 16 is positioned on the piston rod 76 adjacent the cap member 12. The cover plate 20 is then connected to the first and second leg portions 26,28, and the adjustable contact pins 56,58 are tightened to bring the plastic contact portions 60 into engagement with the piston rod 76. The contact pins 56,58 are adjusted to substantially center the piston rod within the cavity 30, and the wrench assembly can be rotated to bring the pins 38 into alignment with the slots 72 in the cap member 12. The wrench assembly 10 is then moved toward the cap member 12 until the pins 38 engage the slots 72, and the contact pins 56,58 are tightened further, if necessary, to prevent the wrench assembly 10 from moving. Force is then applied to the handle member 18 to remove the threaded cap member 12 from the cylinder barrel 14. As the wrench assembly 10 is rotated about the piston rod 76, the non-metallic contact portions 60 prevent marring of the surface of the piston rod 76. Assembly of the threaded cap member 12 to the hydraulic cylinder barrel is a similar operation.

Other aspects, objects, and advantages of this invention can be obtained from a study of the drawings, the disclosure, and the appended claims.

We claim:

1. An adjustable spanner wrench assembly for installing and removing components of a structure, comprising:

a head member having a circumferential surface and a generally u-shaped configuration defining first and second leg portions and an interior cavity;

a cover plate having first and second spaced apart surface portions and a plurality of first and second apertures extending through said plate from said first surface portion to said second surface portion;

a handle member connected to said circumferential surface of said head member;

an adapter plate having a generally u-shaped configuration defining first and second leg portions and a plurality of component engagable pins, said adapter plate being adapted to be connected to said head member;

a plurality of first adjustable contact pins associated with said head member and adapted to extend into said interior cavity; and a plurality of second adjustable contact pins associated with said cover plate and being adapted to be positioned in said first apertures.

2. An adjustable spanner wrench assembly, as set forth in claim 1, wherein each of said first and second adjustable contact pins includes a non-metallic contact portion and a threaded shaft portion, said contact portion being connected to said shaft portion by a swivel connection.

3. An adjustable spanner wrench assembly, as set forth in claim 1, including a plurality of threaded fasteners and wherein said cover plate is removable connected to said first and second leg portions of said head member by said threaded fasteners which extend through said second apertures.

4. An adjustable spanner wrench assembly, as set forth in claim 1, wherein said head member defines a longitudinal slot at the base of said cavity and including a rectangularly shaped non-metallic plate positioned in said slot.

5. An adjustable spanner wrench assembly, as set forth in claim 1, wherein said component engagable pins are connected to said adapter plate leg portions and extend radially inwardly toward said cavity.

6. An adjustable spanner wrench assembly, as set forth in claim 5, wherein said adapter plate leg portions define a step portion and said component engagable pins are positioned above said step portion.

7. An adjustable spanner wrench assembly, as set forth in claim 1, wherein said adapter plate defines an axial centerline and wherein said component engagable pins are connected to said adapter plate leg portions and extend outwardly of said adapter plate leg portions and substantially parallel to said axial centerline.

8. An adjustable spanner wrench assembly, as set forth in claim 7, wherein said adapter plate leg portions define a step portion and said component engagable pins extend outwardly of said step portion.

9. An adjustable spanner wrench assembly, as set forth in claim 2, wherein said contact portion of said first and second adjustable pins is a plastic material.

10. An adjustable spanner wrench assembly, as set forth in claim 4, wherein said plate is a plastic material.

11. An adjustable spanner wrench assembly, as set forth in claim 1, wherein said handle member defines a rectangular shaped through hole.

12. An adjustable wrench assembly for assembling and disassembling components of a structure, comprising:

a head member having a generally u-shaped configuration defining first and second leg portions and an interior cavity between said leg portions, said head member further defining a longitudinal slot at the base of said cavity;

a rectangularly shaped non-metallic plastic plate adapted to be positioned in said longitudinal slot;

a cover plate having a plurality of first apertures, said cover plate being adapted to be releasably connected to said head member to partially enclose said cavity;

a handle member connected to said head member;

an adapter plate having a generally u-shaped configuration defining first and second leg portions, and a plurality of component engagable pins, said adapter plate being adapted to be releasably connected to said head member;

a plurality of first adjustable contact pins connectable to said head member and having a contact portion adapted to extend into said interior cavity; and a plurality of second adjustable contact pins connectable to said cover plate and having a contact portion adapted to extend into said interior cavity when said cover plate is connected to said head member, said second adjustable pins being adapted to be positioned in said first apertures.

13. An adjustable wrench assembly, as set forth in claim 12, wherein said contact portion of said first and second contact pins is a non-metallic plastic material.

14. An adjustable wrench assembly, as set forth in claim 12, wherein said component engagable pins extend radially inwardly toward said interior cavity.

15. An adjustable wrench assembly, as set forth in claim 12, wherein said adapter plate defines an axial centerline and wherein said component engagable pins extend outwardly of said adapter plate leg portions and substantially parallel to said axial centerline.

16. An adjustable wrench assembly, as set forth in claim 12, wherein each of said first and second contact pins include a threaded shaft portion and a swivel portion adapted to connect said shaft portion to said contact portion.

* * * * *